US005370265A

United States Patent [19]

Mackay et al.

[11] Patent Number: 5,370,265

[45] Date of Patent: Dec. 6, 1994

[54] DISPLAY DEVICE

[75] Inventors: Roy A. Mackay, Edinburgh, Scotland; Christopher J. T. Drake, Leicester, England; Kevin N. Hodges, Leicester, England; Colin D. Parkinson, Leicester, England

[73] Assignee: Retail Holdings Limited, Edinburgh, Scotland

[21] Appl. No.: 107,785

[22] PCT Filed: Feb. 20, 1991

[86] PCT No.: PCT/GB91/00268

§ 371 Date: Aug. 19, 1993

§ 102(e) Date: Aug. 19, 1993

[87] PCT Pub. No.: WO92/14389

PCT Pub. Date: Sep. 3, 1992

[51] Int. Cl.[5] ..... B65H 1/08

[52] U.S. Cl. ..... 221/279; 221/155; 221/124; 221/130; 221/131; 221/17

[58] Field of Search ..... 221/155, 279, 123, 124, 221/130, 131, 17, 20, 287, 288, 312 R

[56] References Cited

U.S. PATENT DOCUMENTS

| | | | |
|---|---|---|---|
| 1,187,541 | 6/1916 | Müller | 221/155 |
| 1,291,420 | 1/1919 | Cough | 221/279 X |
| 2,529,600 | 11/1950 | Dixon | 221/131 X |
| 2,636,795 | 4/1953 | Williams | 221/131 X |
| 3,172,713 | 3/1965 | Rupert | 221/131 |
| 3,512,679 | 5/1970 | Stoltz | 221/155 X |
| 3,885,706 | 5/1975 | Lodge | 221/279 |
| 4,457,512 | 7/1984 | Stevenson . | |
| 4,821,917 | 4/1989 | Brown | 221/130 X |
| 4,907,707 | 3/1990 | Crum | 221/279 X |
| 5,123,551 | 6/1992 | King | 221/279 X |

FOREIGN PATENT DOCUMENTS

| | | | |
|---|---|---|---|
| 749798 | 1/1967 | Canada | 221/279 X |
| 2245390 | 9/1974 | France . | |
| 2617385 | 1/1989 | France | 221/279 X |
| 2624106 | 6/1989 | France | 221/312 R X |
| WO8300291 | 2/1983 | WIPO . | |
| WO8904129 | 5/1989 | WIPO . | |

*Primary Examiner*—Cheryl L. Gastineau
*Assistant Examiner*—Dean A. Reichard
*Attorney, Agent, or Firm*—Foley & Lardner

[57] ABSTRACT

A display device has a display surface defined by support members which support various types of display modules including a card dispenser which supports a vertical stack of cards in a large capacity holder which is inclined rearwardly and upwardly behind the display surface. Cards are dispensed through a slot in a face plate onto a projecting inclined surface of a tongue which causes the card to flex ensuring that only one card is dispensed at a time. The stack of cards in the holder is urged forwardly by a lightweight pusher mounted on a track in the holder in a nonreturn manner.

8 Claims, 6 Drawing Sheets

DISPLAY DEVICE

FIELD OF THE INVENTION

The present invention relates to a display device in the form of a display board or stand intended primarily for advertising purposes and to a card dispenser for use as a module in such a display device.

DESCRIPTION OF THE PRIOR ART

It has been customary for some time for newsagents, supermarkets and do-it-yourself (DIY) stores to provide facilities whereby private customers and local businesses can advertise their services. In the simplest form, the shopkeeper provides a notice board and advertisers pay for their advertisement cards to be displayed on the board for an appropriate period of time. This method of advertising requires that the potential customer should take down details of the advertised goods or services in which they are interested. During a shopping expedition, when the potential customer is encumbered by bags and children, this is not always practical. Therefore, it is clearly desirable to provide some facility for the dispensing of leaflets or cards which the potential customer can take away. Such displays of leaflets and the like require frequent replenishing if customers are not to be disappointed. Moreover, if such displays are left in unattended locations, there is a risk that the entire stock of cards or leaflets will be removed by one person and scattered in the vicinity, resulting in loss of the advertising service and damage to the environment. This makes this type of display advertising unacceptable to advertisers and the shopkeepers who provide the location alike.

There are therefore two primary technical problems to be solved if a commercially attractive display board advertising service is to be promoted at retail locations, such as supermarkets and DIY stores, where there is a continuous flow of potential local consumers, which advertisers wish to target.

The first of these problems is to permit some permanent record of the advertised goods or services to be taken away by the potential customer. This allows the advertising to be more effective and also provides feedback to the advertiser as to the interest in his product.

The second problem is to prevent vandalism so that the feedback effect is preserved, the local environment does not become littered and the advertising effect of the stock of leaflets or cards is maximized.

In solving these problems, a number of subsidiary technical problems arise as will be apparent from the following description.

Various attempts have been made to solve the technical problems set out above. For example, WO-A-8904129 (Glenmead Pty Limited) shows a display device to which a number of card dispensers are fixed. These card dispensers allow a business card to be extracted by a potential customer from a horizontal stack stored in the dispensing apparatus. The arrangement described suffers from a number of problems. In particular, the stock of cards available for dispensing is limited by the space available for each dispenser on the board. Further, it is necessary to disassemble the entire board in order to replenish one dispenser. Thirdly, the mechanical arrangement by means of which the stack of cards is urged upwardly is prone to failure. Fourthly, with this type of display board, it is not immediately apparent to a potential customer that he is able to abstract a card of the type displayed to take away. A further disadvantage of the display board described in this piece of prior art is that it presents a complex and untidy shape to the potential customer giving rise to problems of keeping the board clean and aesthetically pleasing. Such a shape presents opportunities for the vandal to break off parts of the display and generally deface it.

In order to solve the problems outlined, the present invention provides a display device which may be assembled from modules including dispensing devices as more specifically defined in the appended claims.

In this specification the term 'card' is used to refer to any laminar member suitable for dispensing one at a time. A 'card' may be a business card or voucher or even be a folded leaflet or flat packet.

SUMMARY OF THE INVENTION

In accordance with a preferred embodiment of the invention, the housing for the stack of cards to be dispensed is in the form of an inclined holder extending rearwardly and upwardly from the face of a display board in which it is received. In this way the capacity of the holder can be made substantial, enough, say, for up to 500 cards, without requiring an overly large surface area of a display board which supports the dispenser. This is because the storage capacity of the holder is provided by increasing the depth of the board which is not normally a particularly critical factor, rather than by increasing the area of the display surface as in W0-A-8904129.

A further advantage is that the removal of a card is an intuitive process requiring no instructions to be given to the potential consumer. Single cards can readily be dispensed through the opening which, preferably, includes a slot and adjacent finger opening. The slot is defined between the face plate and an inclined tongue projecting forwardly and downwardly from the front face of the dispenser. The flexure of the card necessary to bring it forward over the tongue ensures that only one card is dispensed at a time. This eliminates the need for complex, friction-based mechanisms for preventing multiple dispensing as may be necessary when the cards are stored in a horizontal stack. Moreover, the thickness of the slot between the face plate of the dispenser and the tongue is not overly critical making manufacturing of the dispenser simpler.

When using a vertical stack of cards, gravity can be used as the means to urge the cards forward towards a dispensing slot. However since the user will apply pressure to the stack to withdraw a card, some mechanism is necessary to prevent a pusher behind the stack from moving backwards up the track. If the pusher relied on its weight alone, the overall weight of the display device would be unacceptably high. Therefore in accordance with a preferred embodiment of the invention a lightweight pusher is mounted in a non-return mannner in a track in the base of the holder.

It is important in a dispenser of this type to prevent jamming of the mechanism. This is achieved in the dispenser of the present invention by the simplicity of its design. Moreover, a latch is preferably provided on the pusher which urges the stack of cards in the holder towards the front face.

Preferably, the latch has a ridged surface which interlocks with a co-operating ridged surface in a track in a base of the holder so that when these surfaces are engaged, the pusher cannot be moved backwards up the inclined holder.

In a preferred embodiment the latch is pivotally mounted relative to the pusher so that, when pivoted out of engagement with the co-operating surface on the base of the holder, the pusher can readily be slid backwards up the holder in order to allow re-stocking of the dispenser.

In a preferred embodiment of the claimed display device, a display board comprises a plurality of horizontally spaced support members between which dispensers and other modules may be mounted. The dispensers are preferably mounted to the support members by means of a locking member releasable from the front of the dispenser by means of a special tool. This has the advantage that individual dispensers can be removed from the board for replenishment without the need to disturb other dispensers or modules fitted to the board.

Preferably the face plates of the dispensers and other modules are sized so that together they tile the complete surface of the display board to present an apparently continuous surface to the viewer from which only the tongues of the dispensers project. This relatively smooth surface tends to discourage vandalism and allows the surface of the board to be cleaned readily.

A further advantage is found in the relatively few moving parts in the dispenser none of which are accessible to or require operation by the potential consumer. This facilitates reliable and easy operation over long periods.

BRIEF DESCRIPTION OF THE DRAWINGS

Other advantageous features of the dispenser and the display device will be appreciated from the following detailed description of a specific embodiment of the invention which will now be described, by way of example only, with reference to the accompanying diagrammatic drawings, in which.

DESCRIPTION OF THE PREFERRED EMBODIMENT

The dispensers 2 to be described in more detail below, are intended to be fitted to a display board as one of several types of display module which may be assembled together in a board in varying combinations depending on the specific requirements of the location where the board is to be sited.

Figure 1:
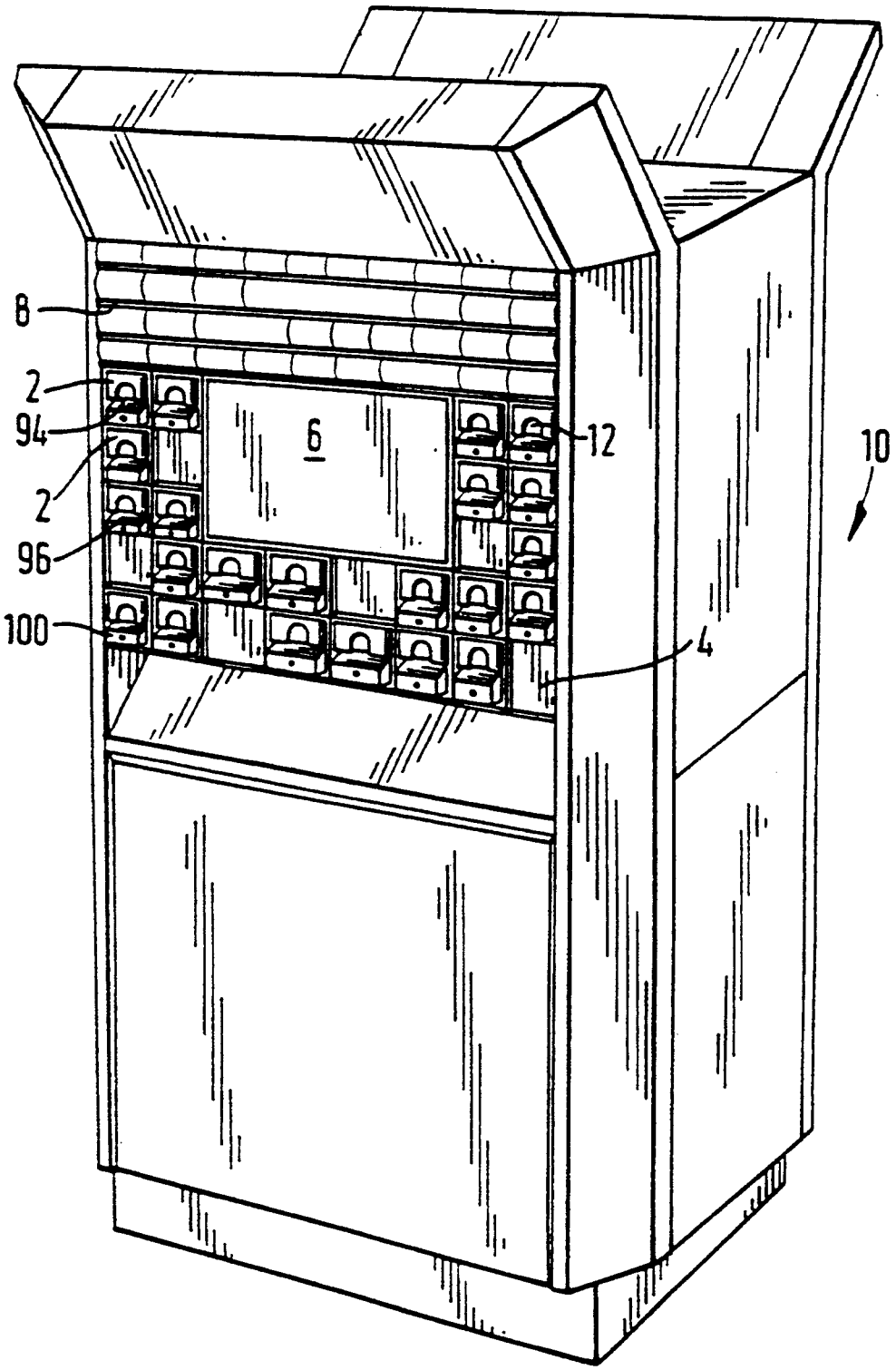
FIG. 1 is a perspective view of a free-standing display device incorporating card dispensers and other display modules.

In FIG. 1, a free-standing display device 10 is shown with display boards on two opposite faces. Each of these boards incorporates the dispenser modules 2, and other display modules such as plain display advertising modules 4, a large notice board module 6, or card supporting tracks 8 for displaying non-commercial advertising cards.

The reader will appreciate that boards may equally well be wall mounted or formed in varying configurations as the location and purpose of the display device demand. The example shown in FIG. 1 is merely one of many possible configurations that may be constructed using the described components.

The key component of the display device to be described is the card dispenser module 2, which is shown in greater detail in FIGS. 2 to 5.

The dispenser 2 is formed from a two piece plastic moulding. The dispenser consists of a face plate 12 behind which a holder 14 extends rearwardly and upwardly at angle of approximately 45° to the face plate 12. The face plate 12 has an opaque border and a central transparent window section through which the face of the card at the front of a stack in the dispenser can be seen. A card removing opening is defined in this window portion of the face plate. A rear wall 16 of the holder is substantially parallel to the face plate 12. A stack of cards (not shown) is inserted in the holder 14 and urged towards the face plate 12 by means of a pusher 18. Each of the cards is oriented in a vertical plane parallel to the face plate and back wall of the holder. One edge of each card is supported on a base 20 of the holder.

A track 22 is defined in the base 20. The track 22 is defined by means of two inwardly facing flanges 24, 26 supporting a ridged surface 28 between them at a lower level. The flanges 24, 26 therefore define two inwardly facing channels along the length of the base. Facing notches 30 are cut into the flanges 24, 26 at the rear of the base. Along the length of the flanges 24, 26 there are further facing notches 32 which are aligned above connecting members 34, which connect the central ridge surface 28 to the remainder of the base 20. With this construction, the track channel in which the pusher 18 is received can readily be formed in the base in a single moulding operation.

Figure 3:
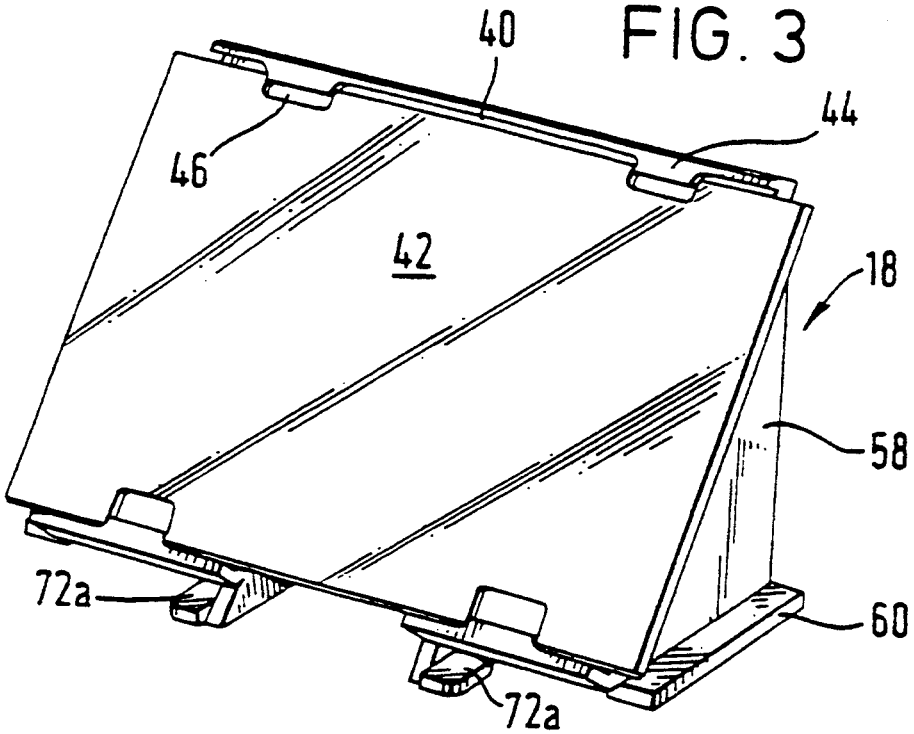
FIG. 3 is a perspective view of a pusher as fitted in the card dispenser of FIG. 2.
Figure 3:
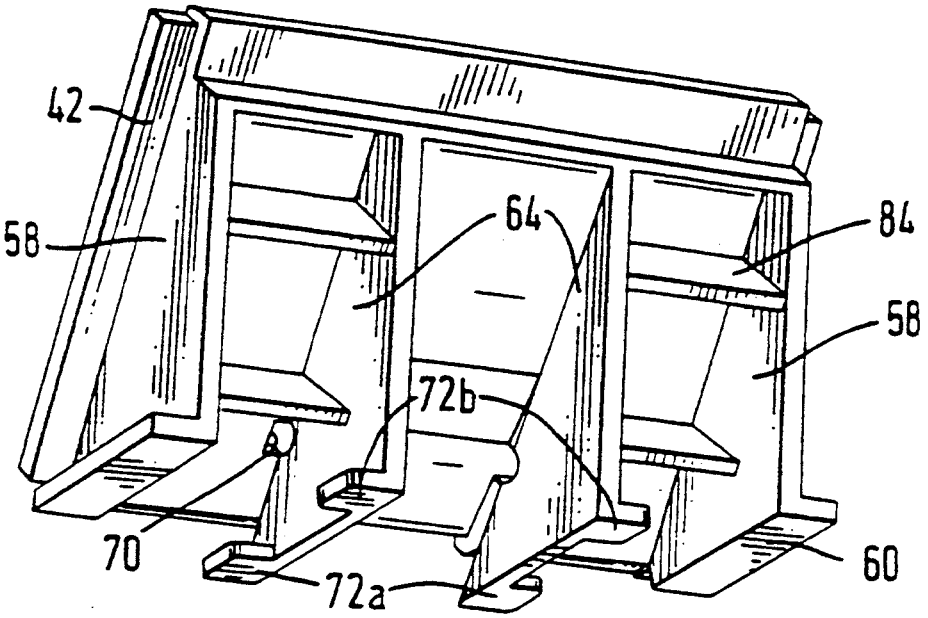
Figure 4:
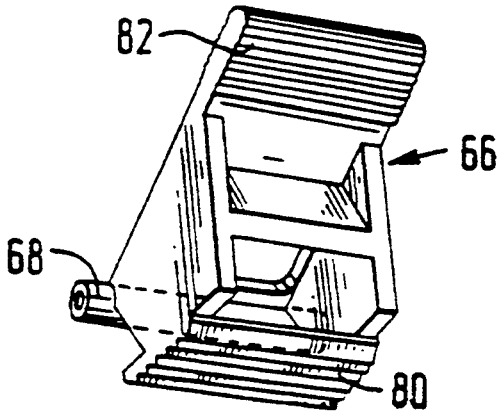
FIG. 4 is an exploded rear view of the pusher of FIG. 3.

The pusher 18, which is shown in more detail in FIGS. 3 and 4, has a front card-supporting surface 40 over which a transparent plastic cover 42 can be removably fitted. A card of the type to be received in the holder is placed behind the cover 42 on the card receiving surface so that, even if the holder is empty, this card is available for display through the transparent window portion in the front plate 12 of the dispenser. The cover 42 is held in position by four integrally formed clips 44 which co-operate with recesses 46 in the cover 42.

The moulding which comprises the pusher 18 has side webs 58 terminating in laterally projecting outer flanges 60 on each side. These flanges 60 are sized to be received in outer upwardly open channels 62, defined between the base 20 of the holder and the side walls of the holder at either side of the track 22.

The moulding of the pusher 18 also includes two intermediate webb portions 64 between which a pivotable latch 66 is fitted. The latch 66 has projecting lugs 68 on either side which are received in corresponding cut outs 70 in the webs 64 to define the pivotal axis of the latch 66. The bases of the webs 64 are each provided with laterally projecting members 72*a* and 72*b*, which are adapted to be received in the inwardly facing channels of the track 22 defined by means of the flanges 22, 24. In this way the pusher 18 can slide up and down the track 22 in the base of the holder. The spacing between members 72*a* and 72*b* corresponds to the spacing between notch 30 at the rear of the holder and the next adjacent notch 32 so that the pusher can be inserted and lifted out of the track in this position. The spacing between adjacent notches 32 in the track is chosen so that it varies from the spacing between members 72*a* and 72*b* so that it is impossible to remove the pusher 18 from the track at any other position. This reduces the risk of the pusher being thrown out of the track during operation of the dispenser.

The base of the latch 66 has a ridged surface 80. The ridged surface 80 and the ridged surface 28 are formed with similar saw-tooth ridges with substantially horizontal and vertical faces. As the pusher slides down the track, the latch freely pivots allowing the pusher to move forwards. However, if pressure is applied to the front face 40 of the pusher, the ridged surfaces 80 and 28 interlock, with respective vertical faces in tight engagement, and it is impossible to move the pusher back up the track. This prevents a user of the dispenser from jamming its operation. Since the pusher cannot be moved backwards up the track, the stack of cards is always maintained in its vertical orientation and however few remain in the holder, they cannot be made to fall over and lie flat on the base of the track by forcing the pusher backwards.

In order to allow the pusher to be moved backwards up the track when the holder is replenished with cards, the latch 66 is pivoted, by means of a finger plate 82, towards the front face 40 of the pusher. This moves the ridged surface 80 out of engagement with the surface 28 and the pusher can then be moved backwards and, if necessary, removed when it reaches the back wall 16 of the holder, but at no other position.

The spacing between the webs 58 forming the side walls of the pusher and the intermediate webs 64 is maintained by means of transverse reinforcing webs 84 formed in the moulding.

The face plate 12 of the holder defines the transparent window section sized to display the cards and containing the card-removing opening 92 which is shaped to define a slot 94, along the base of the window, which is sufficiently wide to permit the passage of a card from the stack. The opening 92 also includes a substantially semi-circular finger opening through which the user can insert his forefinger to draw down the uppermost card on the stack and extract it through the slot 94.

Figure 5:
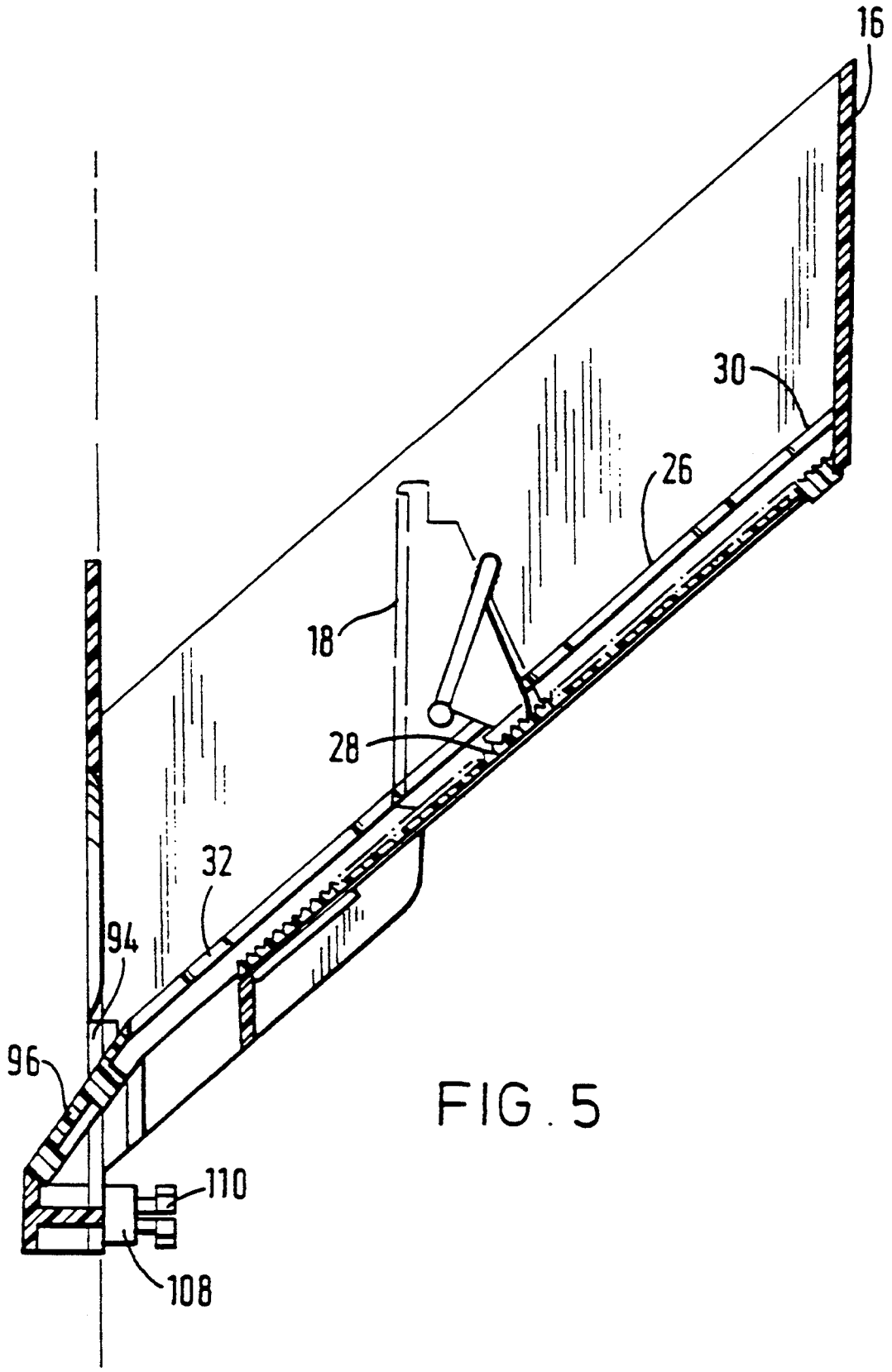
FIG. 5 is a longitudinal section through a dispenser.

A moulding which defines the base of the holder and track extends outwardly of the front face of the holder to define an upper surface 96 of a projecting tongue 100 defined by the face plate. The surface 96 of the tongue is inclined more steeply downwardly from the slot 94 than the base of the track as can be seen in FIG. 5. This minimizes the amount by which the tongue 100 projects from the face of a display board.

In use, the potential customer who requires to extract a card from the dispenser 2 inserts his index finger through the finger opening and pulls down the uppermost card. As the lower edge of the card reaches the slot 94, it is forced to flex as it moves forwardly over the tongue surface 96. Because of this flexion it is only possible to remove one card through the slot 94 at once even though the width of the slot may be sufficient for several cards to be extracted.

The edge of the surface 96 is supported on a wall 102 which projects from the face plate 12 to define the tongue 100.

Figure 6:
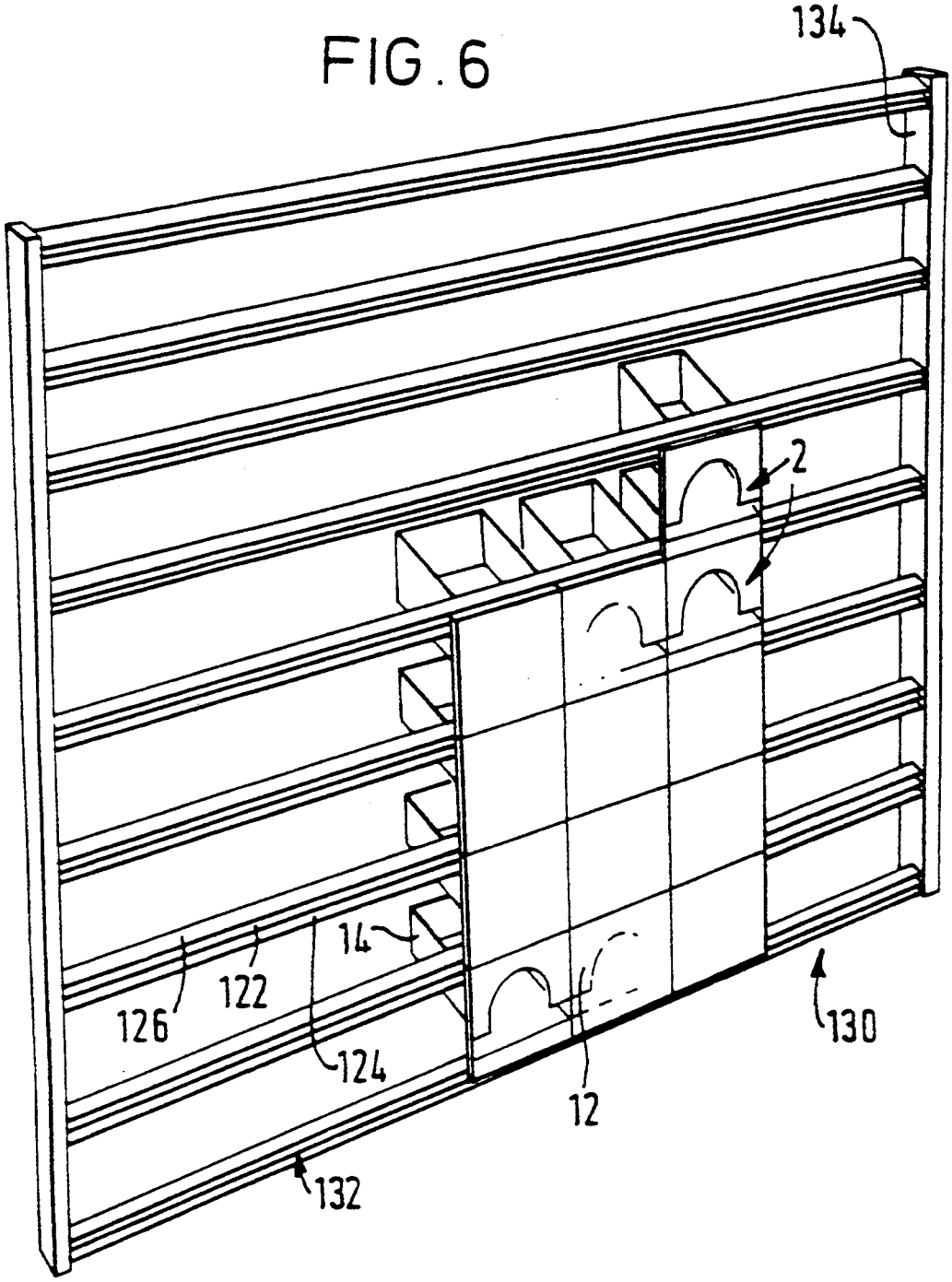
FIG. 6 is a perspective view through part of a display board showing how the dispensers and other modules may be mounted.
Figure 7:
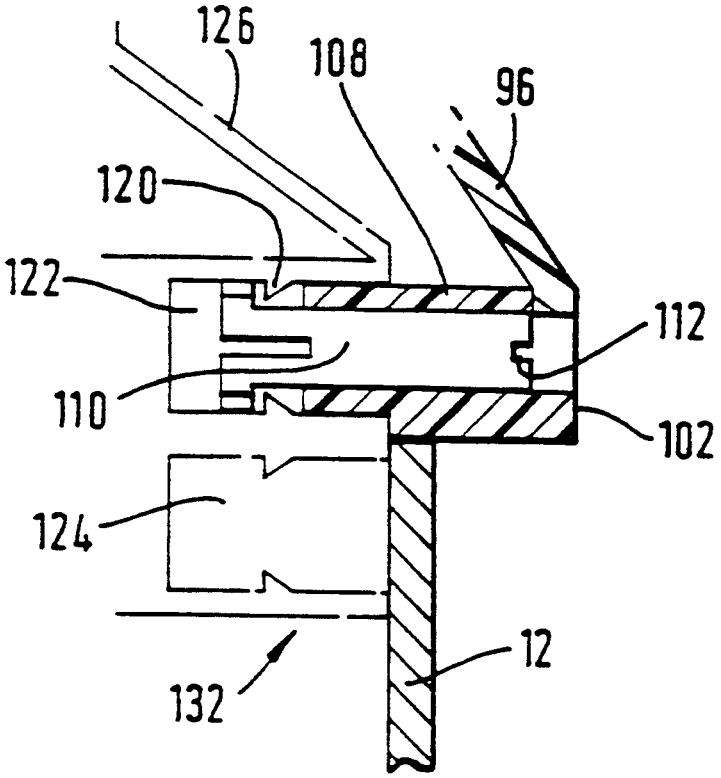
FIG. 7 is a partial section through a support member of the display board showing one example of a fixing mechanism.

As illustrated in FIG. 6, the display board, which is fitted into the structure that makes up a complete display device 10, is essentially a framework 130 of horizontally spaced support members 132 secured to a vertical support 134 at each end. This framework 130 can readily be constructed of various sizes to fit into different types of display devices. The spacing between the support members 132 is just less than the height of the modules to be fitted to them. Each support member has two outwardly open channels 122, 124 positioned one above the other. Each channel has two inwardly facing longitudinal ribs 120 formed on the upper and lower walls of the channel. The upper surface 126 of each support member 132 is inclined at the same angle as the underside of the holder in order to provide support for the holder of a dispenser module 2 fitted to the framework 130.

Figure 2:
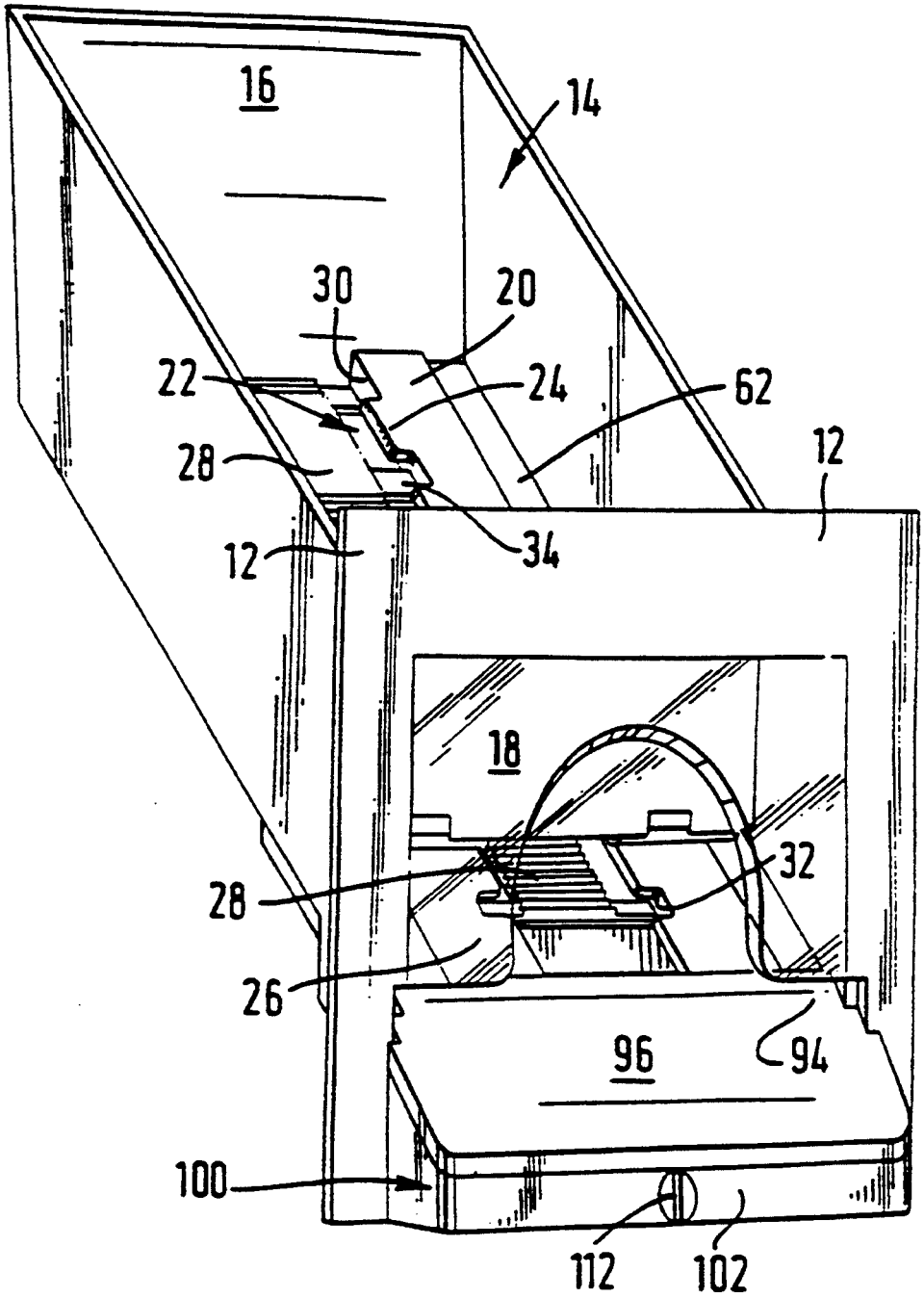
FIG. 2 is a perspective view of a card dispenser.

A fixing mechanism for securing modules such as the dispenser 2 to the framework 130 of support members 132 is located in the front wall 102 of the projecting tongue 100. In the embodiment illustrated, a cylindrical support housing 108 extends rearwardly from the front wall 102 in order to rotatably support a pin member 110. The front face of the pin member 110 is provided with a diametrically extending groove 112, which is visible from the front of the cylindrical pin receiving housing as shown in FIG. 2. The front face of the pin may be flush with the surface of the wall 102, as shown in FIG. 2, or it may be recessed for greater security so that a special tool is necessary in order to rotate the pin member by means of engagement with the groove 112.

The remote end of the pin member 110 is bifurcated and headed. The head of the pin member is circular in plan with two segments cut away from either side. In one orientation of the pin (the locking position) the head locks behind transverse ribs 120, in the corresponding channel 122 of the support member 132. In an orientation at 90° to that locking position, the head member can be withdrawn from the channel 122 in the support member, since the cut away segments allow the head to pass the ribs 120.

In use a module is removed from the display board by turning the pin member 110, so that it can be withdrawn into the cylindrical support and out of engagement with the ribs 120 of the channel. When the module has been so released, it can be withdrawn forwardly and with a pivoting motion to allow the upwardly inclined holder 14 to be extracted from between the support members 132. The holder can then be replenished and, if the type of cards in the holder is changed, the card behind the transparent cover 42 in the pusher is also changed. It will be appreciated that a single dispenser 2 can be removed and replaced or restocked without disturbing the remaining modules in the display.

It will be noted that the face plate 12 of the adjacent module extends over the face of the lower channel 124, so that the support members are completely obscured when the board is entirely covered by modules.

It will be appreciated that modules may be fitted to the display board by various alternative types of fixing mechanisms.

Since all the components of the dispenser 2 as well as the display device itself can be formed by plastic moulding, the device may be constructed so as to be relatively light in weight, yet robust and requiring low maintenance.

We claim:

1. A display device comprising a framework of support members and at least one dispenser for cards secured to a support member, wherein the dispenser comprises:

a face plate defining a card removing opening;

a holder behind the face plate having a base which extends upwardly and rearwardly to support a stack of cards to be dispensed, each card lying in a plane substantially parallel to the face plate;

a pusher mounted on a track in the base of the holder to urge the stack of cards towards the face plate; and a tongue projecting outwardly from the face plate adjacent the card removing opening to define a surface inclined relative to the face plate and over which a card passing through said card removing opening passes.

2. A display device as claimed in claim 1 wherein the track and pusher of the card dispenser have co-operating ridged surfaces shaped so that the pusher can slide towards the face plate but is prevented from moving in the reverse direction by the engagement of the surfaces.

3. A display device as claimed in claim 2 wherein the ridged surface on the pusher of the card dispenser is provided on a pivotable latch, which can be used to move the surfaces out of engagement with one another to allow the pusher to be moved back up the track to allow a stack of cards to be replenished.

4. A display device as claimed in claim 1 wherein the card removing opening of the card dispenser comprises a slot adjacent the projecting tongue and a finger opening to allow a user to touch a card and direct it out through the slot.

5. A display device comprising a framework of support members and at least one dispenser for cards secured to a support member, wherein the dispenser comprises:

a face plate defining a card removing opening;

a holder behind the face plate having a base which extends upwardly and rearwardly to support a stack of cards to be dispensed, each card lying in a plane substantially parallel to the face plate;

a pusher mounted on a track in the base of the holder to urge the stack of cards towards the face plate; and a tongue projecting outwardly from the face plate adjacent the card removing opening to define a surface inclined relative to the face plate; wherein the pusher of the card dispenser comprises means for supporting a card on its surface, the card being displayed through a transparent window section of the face plate when there are no removable cards in the holder.

6. A display device as claimed in claim 1 wherein the track of the card dispenser comprises two inwardly facing flanges defining therebelow corresponding inwardly facing channels along the length of the base which are sized to receive in a slidable manner laterally projecting members on the pusher.

7. A display device comprising a framework of support members and at least one dispenser for cards secured to a support member, wherein the dispenser comprises:

a face plate defining a card removing opening;

a holder behind the face plate having a base which extends upwardly and rearwardly to support a stack of cards to be dispensed, each card lying in a plane substantially parallel to the face plate;

a pusher mounted on a track in the base of the holder to urge the stack of cards towards the face plate; and a tongue projecting outwardly from the face plate adjacent the card removing opening to define a surface inclined relative to the face plate; wherein the track of the card dispenser comprises two inwardly facing flanges defining therebelow corresponding inwardly facing channels along the length of the base which are sized to receive in a slidable manner laterally projecting members on the pusher; and further wherein a plurality of notches are cut into the flanges of the card dispenser to permit removal of the pusher from the track in one relative position.

8. A display device as claimed in claim 1 wherein a plurality of modules is attached to said framework and wherein said at least one card dispenser is secured to a support member such that it can be removed from the display device without disturbing any of said modules attached to said framework.

* * * * *